US005085603A

United States Patent [19]

Haluzak

[11] Patent Number: 5,085,603

[45] Date of Patent: Feb. 4, 1992

[54] MARINE DRIVE WITH STEERING TORQUE COMPENSATION

[75] Inventor: William Haluzak, Hartford, Wis.

[73] Assignee: Brunswick Corporation, Skokie, Ill.

[21] Appl. No.: 630,016

[22] Filed: Dec. 19, 1990

[51] Int. Cl.[5] ..... B63H 25/42

[52] U.S. Cl. ..... 440/51; 440/900

[58] Field of Search ..... 440/51, 53, 66, 78, 440/900, 76, 49

[56] References Cited

U.S. PATENT DOCUMENTS

| | | | |
|---|---|---|---|
| 3,799,103 | 3/1974 | Granholm | 440/66 |
| 3,817,202 | 6/1974 | Holtermann | 440/66 |
| 4,708,672 | 11/1987 | Bentz et al. | 440/51 |

OTHER PUBLICATIONS

"Everything You Need To Know About Propellers", Mercury Marine, Brunswick Corp., Manual QS5-38-4-10M, Part No. 90-86144, pp. 30-31, 1984.

*Primary Examiner*—Edwin L. Swinehart

*Attorney, Agent, or Firm*—Andrus, Sceales, Starke & Sawall

[57] ABSTRACT

A marine drive (20) has a trim tab (50) with a flair (56) on one side (58) thereof at an upper portion (52). When the drive is trimmed in, the flair is unshrouded by the anti-ventilation plate (34) and diverts mainstream water flow therearound, which produces a force on the other side (62) of the trim tab opposite the flair which conteracts steering torque. In another embodiment, a variable compensation flair (72) is provided.

5 Claims, 2 Drawing Sheets

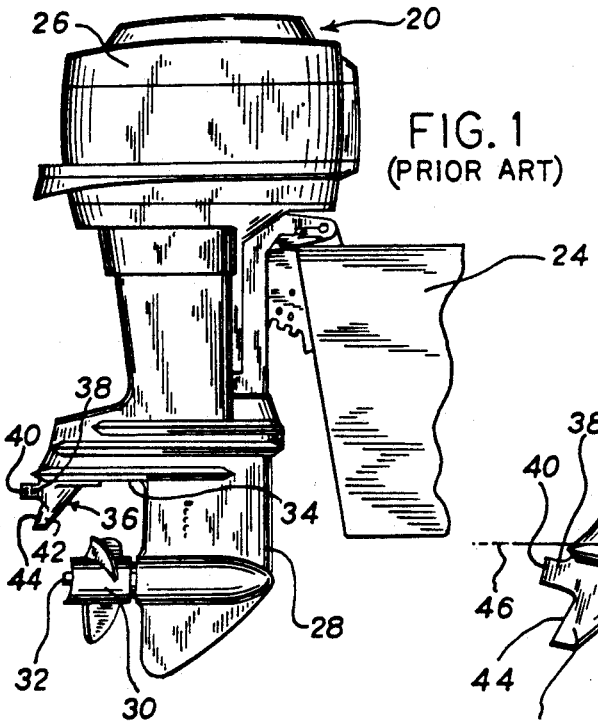
FIG. 1
(PRIOR ART)
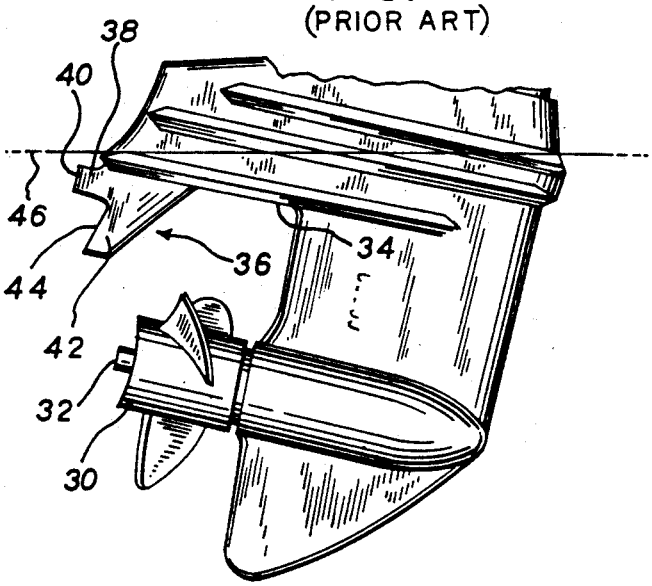
FIG. 2
(PRIOR ART)
FIG. 3
(PRIOR ART)
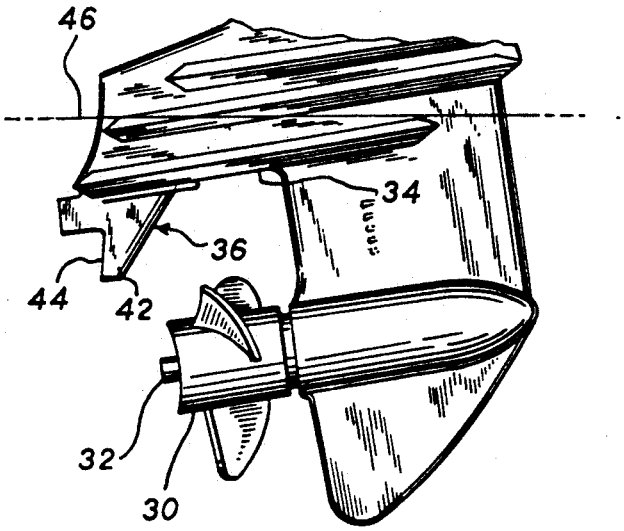
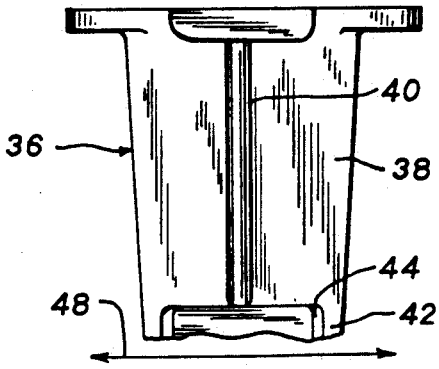
FIG. 4
(PRIOR ART)

MARINE DRIVE WITH STEERING TORQUE COMPENSATION

BACKGROUND AND SUMMARY

The invention relates to marine drives, and more particularly to correction of steering torque.

A marine drive having a lower gearcase and a submerged propeller is subject to steering torque, particularly when the drive is trimmed out or trimmed in. Trimming in or out changes the relative pitch angle of the propeller blades to create an imbalance between the downwardly moving blade on one side and the upwardly moving blade on the other side, which right/left imbalance causes a right or left turn. To counteract this steering torque, it is known in the prior art to provide an adjustable trim tab which can be moved left or right through a given adjustment range. The driver selects a trim tab position according to the engine trim position and steering torque that he desires to balance.

The present invention provides another solution for correcting steering torque. In the present invention, the trim tab, which may or may not be adjustable, is provided with a flair on one side thereof along its upper portion. When the drive is trimmed in, the flair is in the mainstream of the water flow and diverts water flow therearound which produces a force on the other side of the trim tab opposite the flair which counteracts steering torque. When the drive is trimmed out, the anti-ventilation plate shrouds the flair from the mainstream of the water flow. This shrouding effect reduces the reaction force produced by the flair.

In one embodiment, the flair is tapered to have increasing lateral width from the bottom of the flair to the top of the flair, such that the more the drive is trimmed in the more of the flair is unshrouded by the anti-ventilation plate, and the more of the flair is in the mainstream of water flow and the greater the lateral width of the flair around which mainstream water flow is diverted, which in turn provides increasing compensating force counteracting the increasing steering torque as the drive is increasingly trimmed in. This embodiment thus provides variable torque correction.

BRIEF DESCRIPTION OF THE DRAWINGS

Prior Art

FIG. 1 shows a marine drive known in the prior art.

FIG. 2 shows a portion of the marine drive of FIG. 1 in a trimmed out position.

FIG. 3 is like FIG. 2 but shows a trimmed in position.

FIG. 4 is a rear view of a portion of the trim tab of FIG. 1.

Present Invention

Figure 5:
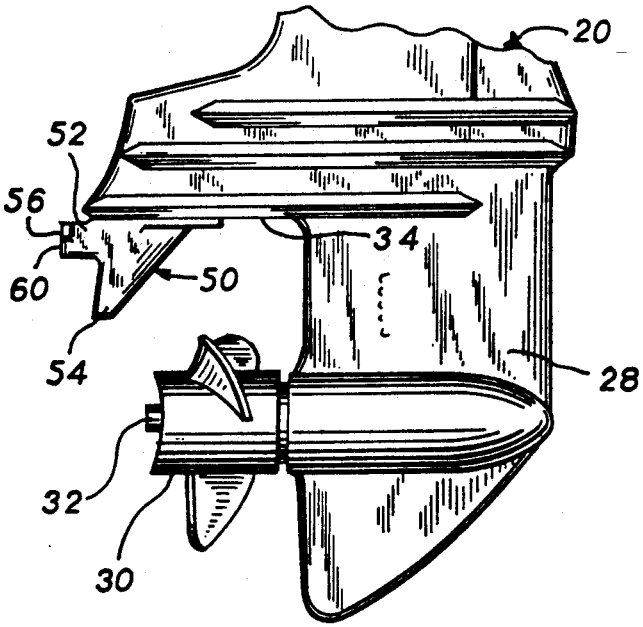

FIG. 5 shows a marine drive including a trim tab in accordance with the present invention.

Figure 6:
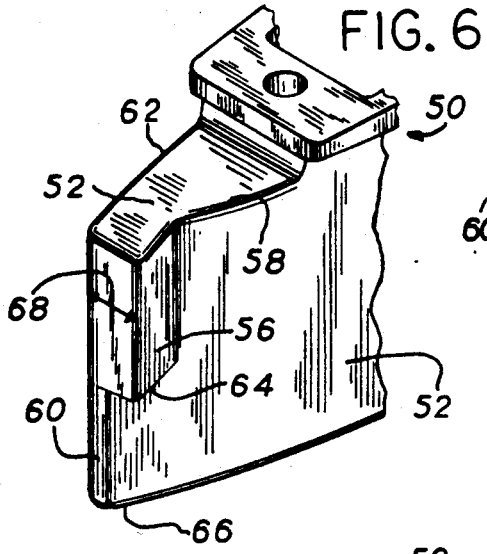

FIG. 6 is a perspective view of a portion of the trim tab of FIG. 5.

Figure 7:
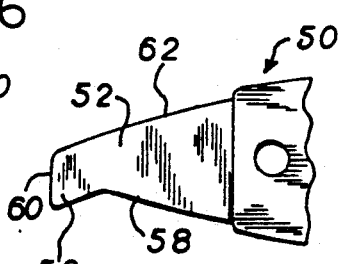

FIG. 7 is a top view of the trim tab of FIG. 6.

Figure 8:
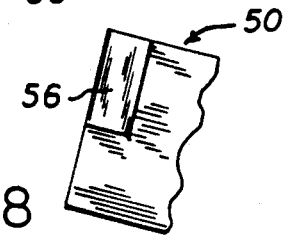

FIG. 8 is a schematic view showing the trim tab of FIG. 6 in a trimmed out position.

Figure 9:
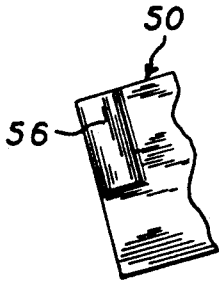

FIG. 9 is like FIG. 8 but shows a trimmed in position.

Figure 10:
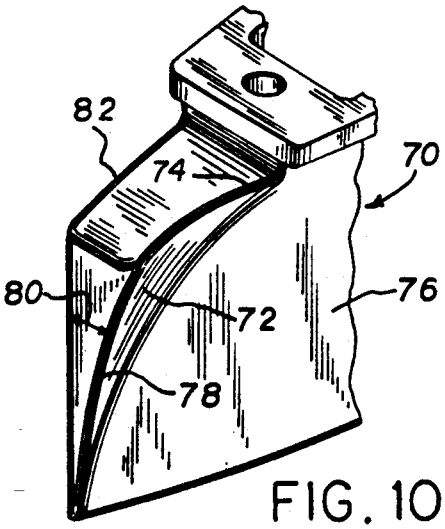

FIG. 10 is a perspective view like FIG. 6 and shows an alternate embodiment.

Figure 11:
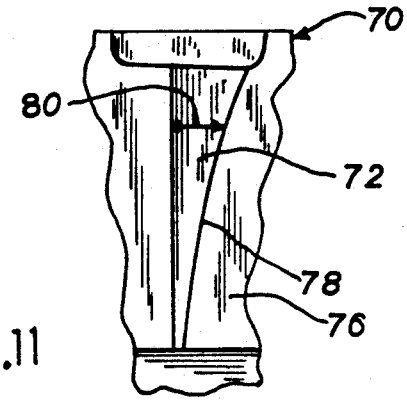

FIG. 11 is an end view of the trim tab of FIG. 10.

Figure 12:
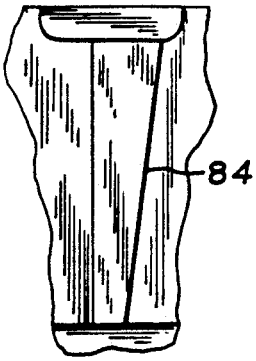

FIG. 12 is a view like FIG. 11 and shows another alternate embodiment.

DETAILED DESCRIPTION

Prior Art

FIG. 1 shows a marine drive 20 mounted on the transom 22 of a boat 24. An outboard drive is shown with an upper powerhead 26 and a lower gearcase 28 having a submerged propeller 30 rotated by propeller shaft 32. The invention is also applicable to stern drives. The gearcase has an anti-ventilation plate 34 above propeller 30, and a trim tab 36 generally above and rearward of the propeller. Trim tab 36 has an upper portion 38 which is closed at the rear as shown at trailing edge 40, FIG. 4. Trim tab 36 has a lower portion 42 which is open at the rear, as shown at opening 44, FIG. 4. The water line is schematically shown at 46. When the drive is trimmed out, FIG. 2, trim tab 36 moves upwardly, to shallower depths. When the drive is trimmed in, FIG. 3, trim tab 36 moves downwardly to deeper depths.

In the case of a right hand rotation propeller, as the drive is trimmed out, FIG. 2, the downward tilt of propeller shaft 32 causes the downwardly moving blade on the right side of the propeller shaft to effectively have less pitch, while the opposite is true of the upwardly swinging blade on the left side. This right/left imbalance produces steering torque and causes a left turn. The driver must resist this force if the boat is to continue in a straight line. As the drive is trimmed in, FIG. 3, the upward tilt of propeller shaft 32 causes the downwardly moving blade on the right side of the propeller shaft to effectively have more pitch, while the opposite is true of the upwardly swinging blade on the left side. This right/left imbalance produces a right hand steering torque and causes a right turn. For further background regarding steering torque, reference is made to "Everything You Need To Know About Propellers", Mercury Marine, Brunswick Corp., Manual QS5-384-1OM, Part No. 90-86144, pages 30–31, 1984.

To help counteract steeringq torque, it is known in the prior art to equip the drive with an adjustable trim tab. The trim tab is mounted to the underside of anti-ventilation plate 34 and may be moved left or right as shown at arrow 48, FIG. 4. To correct left hand steering torque, FIG. 2, the trailing edge 40 of the trim tab is moved to the left in FIG. 4. To correct right hand steering torque, FIG. 3, the trailing edge 40 of the trim tab is moved to the right in FIG. 4. For further background regarding trim tab adjustment, reference is made to page 31 of the above noted "Everything You Need To Know About Propellers".

For a left hand rotation propeller, the steering torques are opposite of those above described, and the trim tab is adjusted oppositely to correct same.

Present Invention

In the present invention, the marine drive includes a trim tab 50, FIG. 5, with an upper portion 52 and a lower portion 54, comparably to trim tab 36. FIG. 5 uses like reference numerals from FIG. 1 where appropriate to facilitate understanding. Trim tab 50 has a flair 56, FIGS. 6 and 7, on one side 58 thereof at upper portion 52 along trailing edge 60.

When the drive is trimmed out, FIGS. 2 and 8, flair 56 is rearward of and generally horizontally aligned with portions of anti-ventilation plate 34. Flair 56 is thus shrouded by anti-ventilation plate 34 because anti-ventilation plate 34 interferes with water flow directly in front of flair 56. Thus, when the drive is trimmed out, flair 56 is moved from the mainstream of water flow to a position which is shrouded by the anti-ventilation plate. This shrouding effect reduces the reaction force produced by flair 56, to be described.

When the drive is trimmed in, FIGS. 3 and 9, flair 56 is in the mainstream of water flow and diverts water flow therearound, which produces increased force or pressure on trim tab side 58, comparably to the concave or lift side of an air foil, and reduced reaction force on the other side 62 of the trim tab opposite flair 56, which counteracts steering torque. The reaction force produced by flair 56 is greatest when flair 56 is unshrouded by anti-ventilation plate 34, FIGS. 3, 5 and 9. The reaction force is smallest when flair 56 is shrouded by anti-ventilation plate 34, FIGS. 2 and 8.

When the propeller is a right hand rotation propeller producing right hand steering torque causing a right turn when the drive is trimmed in, flair 56 is provided on the right hand side 58 of the trim tab. For a left hand rotation propeller producing left hand steering torque causing a left turn when the drive is trimmed in, flair 56 is provided on the left hand side 62 of the trim tab.

In the embodiment shown in FIG. 6, flair 56 extends downwardly a given length along trim tab 50, and has a lower end 64 spaced above the lower end 66 of upper portion 52 of trim tab 50. Flair 56 has a constant lateral width 68 along the entire length thereof.

In another embodiment, FIGS. 10 and 11, trim tab 70 is provided with a variable compensation flair 72 on one side 74 thereof at upper portion 76 of the trim tab. Flair 72 is tapered along a continuous curve as shown at 78 to have increasing lateral width 80 from the bottom of the flair to the top of the flair, such that the more the drive is trimmed in, the more of the flair is moved into the mainstream of water flow and unshrouded by anti-ventilation plate 34. The flair diverts water flow therearound which produces a force on the other side 82 of the trim tab opposite flair 72, which counteracts steering torque. The more the drive is trimmed in, the more of flair 72 is in the mainstream of water flow, and the greater the lateral width 80 of the flair around which the mainstream of water flow is diverted, which in turn provides increasing compensating force counteracting the increasing steering torque as the drive is increasingly trimmed in, such that flair 72 provides variable compensation of the steering torque. Flair 72 is preferably continuously curved along its entire length.

In another embodiment, FIG. 12, flair 84 is tapered along its entire length along a straight taper.

It is recognized that various equivalents, alternatives and modifications are possible within the scope of the appended claims.

I claim:

1. A marine drive comprising a lower gearcase having a submerged propeller driven in one direction of rotation and producing steering torque in a given direction when said drive is trimmed in, the more said drive is trimmed in the greater said steering torque, said gearcase having an anti-ventilation plate above said propeller, and a trim tab extending downwardly from said anti-ventilation plate generally above and rearward of said propeller, at least the upper portion of said trim tab being shrouded by said anti-ventilation plate when said drive is trimmed out, said trim tab having a variable compensation flair on one side thereof at said upper portion, said flair extending downwardly a given length along said trim tab and tapered to have increasing lateral width from the bottom of said flair to the top of said flair such that the more said drive is trimmed in the more of said flair is unshrouded by said anti-ventilation plate, such that said flair diverts mainstream water flow therearound which produces increased force on the flair side of said trim tab and reduced force on the other side of said trim tab opposite said flair which counteracts said steering torque, the more said drive is trimmed in the greater the lateral width of said flair around which mainstream water flow is diverted which in turn provides increasing compensating force counteracting the increasing steering torque as said drive is increasingly trimmed in, such that said flair provides variable compensation of said steering torque.

2. The invention according to claim 1 wherein said trim tab has an upper portion with a rear trailing edge, and has a lower portion below said upper portion, and wherein said flair is at said rear trailing edge and is tapered downwardly along said rear trailing edge.

3. The invention according to claim 2 wherein said flair is tapered along its entire length.

4. The invention according to claim 2 wherein said flair is tapered along a continuous curve.

5. The invention according to claim 4 wherein said continuous curve extends along the entire length of said flair.

* * * * *